US006013587A

United States Patent [19]

Truong et al.

[11] Patent Number: 6,013,587

[45] Date of Patent: Jan. 11, 2000

[54] NONWOVEN ARTICLES

[75] Inventors: Jack G. Truong, Minneapolis; Willa M. Studiner, Oakdale; Bradford B. Wright, Cottage Grove; Michael M. Rock, Jr., Minneapolis, all of Minn.

[73] Assignee: Minnesota Mining and Manufacturing Company, St. Paul, Minn.

[21] Appl. No.: 08/655,048

[22] Filed: May 29, 1996

Related U.S. Application Data

[62] Division of application No. 08/536,071, Sep. 29, 1995, Pat. No. 5,641,563, which is a continuation of application No. 08/070,270, Jun. 2, 1993, abandoned.

[51] Int. Cl.[7] ..... D04H 1/64

[52] U.S. Cl. ..... 442/166; 442/59; 442/102; 442/104

[58] Field of Search ..... 442/59, 104, 102, 442/166

[56] References Cited

U.S. PATENT DOCUMENTS

| | | | |
|---|---|---|---|
| 2,938,812 | 5/1960 | Marzocchi et al. | 117/126 |
| 3,253,715 | 5/1966 | Painter et al. | 210/504 |
| 3,518,041 | 6/1970 | Brelich | 8/115.7 |
| 3,663,470 | 5/1972 | Nishimura et al. | 260/2.5 |
| 3,673,125 | 6/1972 | Takahashi et al. | 260/2.5 |

(List continued on next page.)

FOREIGN PATENT DOCUMENTS

| | | |
|---|---|---|
| 63059481 | 4/1965 | Japan . |
| 72046896 | 10/1969 | Japan . |
| 7877672 | 1/1980 | Japan . |
| 60-144305 | 7/1985 | Japan . |
| 61-185728 | 8/1986 | Japan . |

(List continued on next page.)

OTHER PUBLICATIONS

Non–woven Bonded Fabrics, Ed. Loss et al. John Wiley & Sons, 1985.

*Hawley's Condensed Chemical Dictionary*, 12$^{th}$ Ed., Van Nostrand Reinhold Company, New York, pp. 937 and 1110 (1993).

(List continued on next page.)

*Primary Examiner*—Kathleen Choi

*Attorney, Agent, or Firm*—Daniel R. Pastirik

[57] ABSTRACT

Nonwoven articles having high durability and absorbent characteristics, and their methods of manufacture, are presented. One preferred article is characterized by (a) a nonwoven web comprised of organic fibers comprised of polymers having a plurality of pendant hydroxyl groups; and (b) a binder comprising an at least partially crosslinked and at least partially hydrolyzed polymeric resin having a plurality of pendant resin hydroxyl groups, the resin crosslinked by a crosslinking agent, the crosslinking agent selected from the group consisting of organic titanates and amorphous metal oxides, the polymeric resin derived from monomers selected from the group consisting of monomers within the general formula wherein:

X is selected from the group consisting of $Si(OR^4OR^5OR^6)$ and $O(CO)R^7$; and $R^1$–$R^7$ inclusive are independently selected from the group consisting of hydrogen and organic radicals having from 1 to about 10 carbon atoms, inclusive, and combinations thereof.

16 Claims, 2 Drawing Sheets

U.S. PATENT DOCUMENTS

| | | | |
|---|---|---|---|
| 3,736,311 | 5/1973 | Subramanian | 260/91.3 |
| 4,002,171 | 1/1977 | Taft . | |
| 4,012,352 | 3/1977 | Deyrup | 260/29.6 |
| 4,258,849 | 3/1981 | Miller . | |
| 4,341,213 | 7/1982 | Cohen . | |
| 4,350,788 | 9/1982 | Shimokawa et al. . | |
| 4,551,377 | 11/1985 | Elves et al. . | |
| 4,567,221 | 1/1986 | Maruyama et al. | 524/436 |
| 4,605,589 | 8/1986 | Orphanides . | |
| 4,622,215 | 11/1986 | Janey . | |
| 4,689,264 | 8/1987 | Fink et al. . | |
| 4,694,037 | 9/1987 | Ofstead | 524/557 |
| 4,729,190 | 3/1988 | Lee . | |
| 4,812,529 | 3/1989 | Chung | 525/326.1 |
| 4,921,884 | 5/1990 | Hammer et al. | 523/106 |
| 4,921,908 | 5/1990 | Ofstead | 525/61 |
| 5,147,344 | 9/1992 | Sachau et al. | 604/368 |
| 5,187,226 | 2/1993 | Kamachi et al. | 525/56 |
| 5,234,590 | 8/1993 | Etienne et al. . | |

U.S. PATENT DOCUMENTS

| | | |
|---|---|---|
| 61-246111 | 11/1986 | Japan . |
| 62-121738 | 6/1987 | Japan . |
| 62-222896 | 10/1987 | Japan . |
| 6238793 | 6/1988 | Japan . |
| 7885521 | 6/1990 | Japan . |
| 389833 | 10/1990 | Japan . |
| 8258639 | 10/1990 | Japan . |
| 419396 | 3/1991 | Japan . |
| 3087247 | 4/1991 | Japan . |
| 3206402 | 9/1991 | Japan . |
| 3213511 | 9/1991 | Japan . |
| 3224628 | 10/1991 | Japan . |
| 04081407 | 3/1992 | Japan . |
| 04209606 | 3/1992 | Japan . |
| 04108109 | 4/1992 | Japan . |
| 04110336 | 4/1992 | Japan . |
| 04114053 | 4/1992 | Japan . |
| 1166919 | 6/1969 | U.S.S.R. . |
| 9207899 | 5/1992 | WIPO . |
| WO 92/07899 | 5/1992 | WIPO . |

OTHER PUBLICATIONS

Gelation of syndiotacticity–rich poly(vinyl alcohol)–phenol–water mixture, Colloid & Polymer Sci, vol. 259, pp. 1147–1150 (1981).

Effect of syndiotacticity on the aqueous poly(vinyl alcohol) gel 4. X–ray diffraction analysis of gel, Colloid & Polymer Sci, vol. 254, pp. 982–988 (1976).

Synthesis and Polymerization Studies of Bicyclo[2.1.0] pentene–1–carbonitrile and Bicyclo[3.1.0] hexane–1–carbonitrile, Macromolecules, vol. 4, No. 2, Mar.–Apr. 1971.

NONWOVEN ARTICLES

This application is a division of U.S. patent application Ser. No. 08/536,071, filed Sep. 29, 1995, now issued as U.S. Pat. No. 5,641,563 which is a continuation of U.S. patent application Ser. No. 08/070,270, filed Jun. 2, 1993, now abandoned.

BACKGROUND OF THE INVENTION

1. Brief Description of the Invention

The invention is drawn toward absorbent, durable nonwoven articles, such as wipes, and methods for their manufacture.

2. Related Art

Synthetic wiping articles comprised of a nonwoven web made from polyvinyl alcohol (PVA) fibers and subsequently coated with covalently crosslinked PVA binder resins are known and have been sold as commercial products for many years. Chemically crosslinked PVAs provide distinct advantages in their usage in synthetic wipes. They increase and improve the elements of a dry wipe, non-linting of the wipe surface, mechanical strength, hydrophilic properties, and may also be cured in the presence of pigments to generate a colored wiping product. While their use has enjoyed considerable success, the currently known PVA binders used in synthetic wipes are chemically crosslinked in immersion baths containing potentially toxic materials, such as formaldehyde, various dialdehydes, methylolamines, and diisocyanates.

Glass and other fibers are sometimes sized (i.e., coated) with PVA coatings insolubilized with polyacrylic acid, or crosslinked with metal complexes, such as aluminum, titanium, silicon, or zirconium chelates, and the like.

U.S. Pat. No. 3,253,715 describes boil proof nonwoven filter media comprising a nonwoven fiber substrate and a binder comprising polyvinyl alcohol and polyacrylic acid. Although cellulosic fibers suitable for filters are described, there is no mention of polyvinyl alcohol fibers having utility. The polyvinyl alcohol fibers used in the present invention are prone to severe shrinkage under the pH and/or temperature conditions described in the '715 patent. In addition, the inventors herein have found that ratios of polyacrylic acid to polyvinyl alcohol in binders described in the '715 patent result in strong, but extremely rubbery, absorbent articles with poor "hand" and dry-wipe properties.

Natural chamois is a highly absorbent article derived from a goat-like antelope, and is commonly used to dry automobiles after washing. The absorbent properties of natural chamois have been emulated in several "synthetic chamois." Synthetic chamois commercially available may be formed from PVA fibers and a PVA binder crosslinked by formaldehyde, which undesirable for ecological reasons. Other synthetic chamois are known to be made from nonwoven fibers and an originally hydrophobic acrylic latex binder which has functional groups to make the binder, and thus the article, hydrophilic. These latter are inexpensive, but have very high drag property.

It would be desirous to develop a nonwoven article suitable for use in absorbing hydrophilic materials employing hydrophilic binders and fibers, without the use of formaldehyde. Such an article would allow the articles to exhibit high durability, good hand properties, low drag, and good dry-wiping properties (picks up water with no streaking) while maintaining absorption and "wet out" properties comparable to known articles. Such articles could be produced using ingredients and methods which are not as harmful to manufacturing personnel, users or the environment as are currently used ingredients. Finally, it would be advantageous if such binders could be cured in the presence of pigments to generate colored wiping products.

SUMMARY OF THE INVENTION

In accordance with the present invention, absorbent nonwoven articles are presented which can be produced using binder crosslinking agents which are less troublesome to handle, and which afford the inventive articles with as good or better absorbency and physical properties than known articles. In addition, certain preferred embodiments of the inventive articles may be made without the use of any chemical crosslinkers.

As used herein the term "absorbent" means the articles of the invention are hydrophilic (and therefore absorbent of aqueous materials).

Thus, a first aspect of the invention is an absorbent nonwoven article comprising:

(a) a nonwoven web comprised of organic fibers, the organic fibers comprised of polymers having a plurality of pendant fiber hydroxyl groups; and (b) a binder comprising an at least partially crosslinked and at least partially hydrolyzed polymeric resin having a plurality of pendant resin hydroxyl groups, the resin crosslinked by a crosslinking agent, the crosslinking agent selected from the group consisting of organic titanates and amorphous metal oxides, the polymeric resin derived from monomers selected from the group consisting of monomers within the general formula

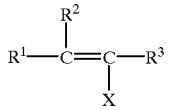

wherein:

X is selected from the group consisting of $Si(OR^4OR^5OR^6)$ and $O(CO)R^7$; and $R^1$–$R^7$ inclusive are independently selected from the group consisting of hydrogen and organic radicals having from 1 to about 10 carbon atoms, inclusive, and combinations thereof.

Preferably, the binder is bonded to at least a portion of the organic fibers through bonds between the pendant fiber hydroxyl groups, a bonding agent, and the pendant resin hydroxyl groups, wherein the crosslinking agent and bonding agent are independently selected from the group consisting of organic titanates and amorphous metal oxides. Also preferred articles in accordance with this aspect of the invention are those wherein the crosslinking agent and bonding agent are the same compounds, and wherein $R^4$–$R^7$ inclusive are methyl ($—CH_3$).

Two particularly preferred articles within this aspect of the invention are those in which the organic titanate crosslinking and/or bonding agent is dihydroxybis (ammonium lactato)titanium or a titanium complex with an alpha-hydroxy acid (e.g., lactic acid) and an alditol (e.g., D-glucitol).

As used herein the terms "bond" and "bonding" are meant to include hydrogen bonds, hydrophobic interactions, hydrophilic interactions, ionic bonds, and/or covalent bonds. The term "crosslinking" means chemical (covalent or ionic) crosslinking.

Especially preferred binders useful in this and other aspects of the invention are aqueous compositions comprising copolymers of vinyl trialkoxysilane and vinyl monomers such as vinyl/acetate, at least partially hydrolyzed with alkali, and at least partially crosslinked with inorganic ions and chelating organic titanates. The inorganic ions (e.g., aluminum, zirconium) react or otherwise coordinate with silanol groups, while the titanates react with secondary hydroxyl groups on the resin. This unique dual curing approach, with possibly different crosslinking chain lengths, allows intermolecular bonding between the PVA polymers of the binder and, theoretically, between the fiber hydroxyl groups and PVA polymers of the binder.

A second aspect of the invention is drawn toward nonwoven absorbent articles similar to those of the first aspect of the invention, wherein the crosslinking agent is selected from the group consisting of dialdehydes, titanates, and amorphous metal oxides.

A third aspect of the invention is an absorbent nonwoven article comprising:

(a) a nonwoven web comprised of a plurality of organic fibers comprising polymers having a plurality of pendant hydroxyl groups; and (b) a binder coating at least a portion of the fibers, the binder comprising polyvinyl alcohol insolubilized with an effective amount of a polymeric polycarboxylic acid (preferably polyacrylic acid).

Preferred within this aspect of the invention are those articles wherein all of the polymers making up the fibers are at least partially hydrolyzed polymerized monomers selected from the group consisting of monomers within the general formula

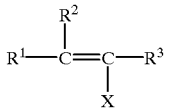

with the provisos mentioned above. The nonwoven web may further include a minor portion of fibers selected from the group consisting of cotton, viscose rayon, cuprammonium rayon, polyesters, polyvinyl alcohol, and combinations thereof.

In contrast to the articles described in the above-mentioned U.S. Pat. No. 3,253,715, we have found that very low amounts of polymeric polycarboxylic acid (in the range of 1 to 5 wt. % as weight of total binder weight) afford the best wiping properties while effectively eliminating binder washout. Further, we have found that pH (negative logarithm of the hydrogen ion concentration in aqueous compositions) ranging from 3 to 3.3 specified by the above-mentioned '715 patent is suitable for the present invention, but pH values up to 4.6 may be utilized, which is much more useful for reducing web shrinkage. The articles of this aspect of the invention employ a polymeric polycarboxylic acid to insolubilize aqueous polyvinyl alcohol, thereby providing absorbent articles with superior water absorption, dry-wipe, and improved strength compared to known articles.

A fourth aspect of the invention is an absorbent nonwoven article comprising:

(a) a nonwoven web comprised of organic fibers, the organic fibers comprised of polymers having a plurality of pendant hydroxyl groups; and (b) a binder coated onto at least a portion of the fibers comprising syndiotactic polyvinyl alcohol, the syndiotactic polyvinyl alcohol having a syndiotacticity of at least 30%.

Articles employing the binder system mentioned in part (b) of this aspect of the invention employ syndiotactic polyvinyl alcohol (s-PVA) as a major (or only) component in the binder. The advantage of this binder is that s-PVA may be employed without a chemical crosslinking agent. This is because s-PVA tends to form microcrystalline regions. Chemical crosslinking through the use of titanates, inorganic ions, and dialdehydes may be employed, but they are rendered optional.

A fifth aspect of the invention is a method of making an absorbent nonwoven article, the method comprising:

(a) forming an open, lofty, three-dimensional nonwoven web comprised of organic fibers, the organic fibers comprised of polymers having a plurality of pendant hydroxyl groups;

(b) entangling the fibers of the web using means for entanglement to form an entangled fiber web;

(c) coating a major portion of the fibers of the entangled fiber web with a binder precursor composition to form a first coated web having first and second major surfaces, the binder precursor composition adapted to form the binder of the second aspect of the invention; and (d) exposing the first coated web to energy sufficient to at least partially cure the binder precursor composition to form a nonwoven bonded web of fibers.

Preferred are those methods wherein the before step (c) the entangled fiber web is calendered, and those methods wherein after step (c) the first coated web is coated on at least one of its first and second major surfaces with a second binder precursor composition. Also preferred are those methods wherein the exposing step includes drying the second binder precursor composition uniformly to form a dried and cured nonwoven web having a surface coating, and those methods wherein the dried and cured nonwoven web is calendered, thereby smoothing and fusing the surface coating.

A sixth aspect of the invention is another method of making an absorbent nonwoven article comprised of a nonwoven web of fibers, at least a portion of the fibers having a binder coated thereon, the method comprising:

(a) forming a nonwoven web comprised of a plurality of organic fibers comprising polymers having a plurality of pendant fiber hydroxyl groups, a major portion of the polymers comprising polyvinyl alcohol;

(b) entangling the fibers of the web using means for entanglement to form an entangled fiber web;

(c) coating a major portion of the fibers of the entangled fiber web with a binder precursor composition to form a first coated web having first and second major surfaces, the binder precursor composition consisting essentially of polyvinyl alcohol and an effective amount of a polymeric polycarboxylic acid; and (d) exposing the first coated web to energy sufficient to insolubilize the polyvinyl alcohol resin to form a nonwoven bonded web of fibers.

Optionally, bonding and crosslinking agents, as discussed herein, may be added to the binder precursor composition.

Finally, a seventh aspect of the invention is another method of making an absorbent nonwoven article comprised of a nonwoven web of fibers, at least a portion of the fibers having a binder coated thereon, the method comprising:

(a) forming a nonwoven web comprised of organic fibers, the organic fibers comprised of polymers having a plurality of pendant hydroxyl groups;

(b) entangling the fibers of the web using means for entanglement to form an entangled fiber web;

(c) coating a major portion of the fibers of the entangled fiber web with a binder precursor composition to form a first coated web having first and second major surfaces, the binder precursor composition consisting essentially of syndiotactic polyvinyl alcohol having a syndiotacticity of at least 30%; and (d) exposing the first coated web to energy sufficient to at least partially cure the binder precursor composition to form a nonwoven bonded web of fibers.

An important aspect of the invention is that articles of the invention may employ inventive binders which allow the articles to exhibit high durability, good feel, reduced drag, and good dry wiping properties while maintaining comparable water absorption and "wet out" properties to existing wipes. In addition, wiping articles of the present invention may also be cured in the presence of pigments to generate colored wiping products.

Preferred articles within the invention may also include in the binder efficacious amounts of functional additives such as, for example, fillers, reinforcements, plasticizers, grinding aids, and/or conventional lubricants (of the type typically used in wiping articles) to further adjust the absorbance, durability, and/or hand properties.

The binders useful in the articles of the invention improve on conventional formaldehyde crosslinking agents which tend to embrittle the web fibers, reducing web strength, softness, and absorption, and which present chemical hazards.

Regarding the methods of the invention, in preferred methods the "exposing" step is preferably carried out in a fashion to afford uniform drying throughout the thickness of the web. Typically and preferably the exposing step is a two stage process wherein the coated web is first dried at a low temperature and subsequently exposed to a higher temperature to cure the binder precursor. In some embodiments, a third, higher temperature curing step is employed. As discussed herein below, to achieve uniformly dried and cured articles, both major surfaces of the uncured web are preferably exposed to a heat source simultaneously, or both major surfaces are sequentially exposed to the heat source. The methods of the invention may also encompass perforating and slitting the dried and cured bonded nonwoven into various finished products.

Further aspects and advantages of the invention will become apparent from the drawing figures and description of preferred embodiments which follows.

DESCRIPTION OF PREFERRED EMBODIMENTS

Figure 1:
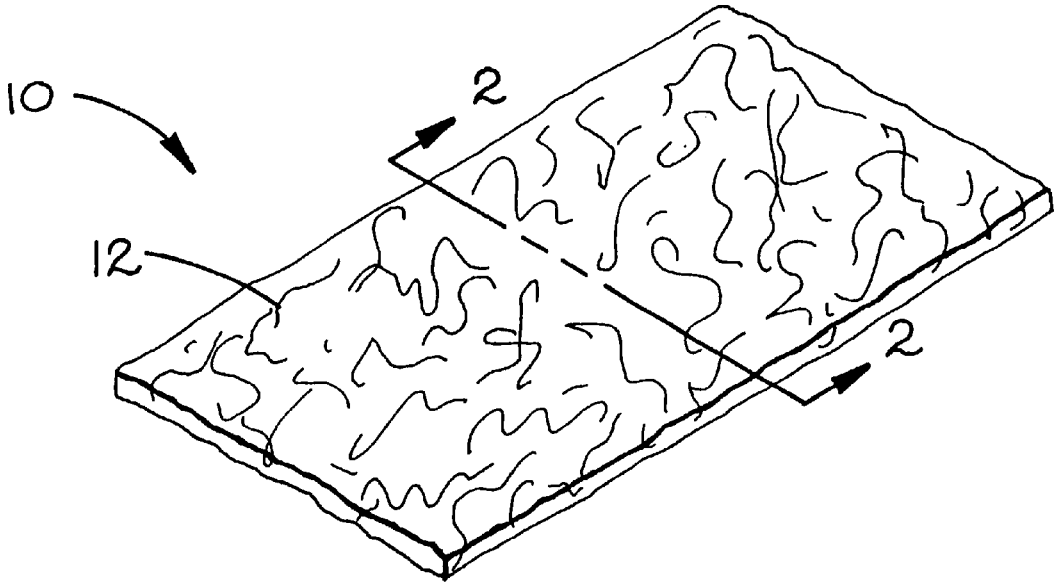
FIG. 1 is a perspective view of a wipe made in accordance with the invention.

1. Articles Employing Chemically Crosslinked PVA Binders

Embodiments within this aspect of the invention include articles comprising a nonwoven web of fibers having coated thereon a binder comprising polyvinyl alcohol (preferably silanol modified) crosslinked with inorganic ions, chelating organic titanates, or combinations thereof.

The nonwoven web of fibers may be made from many types of hydrophilic fibers, and may include a minor portion of hydrophobic fibers, selected from the following fiber types: cellulosic-type fibers, such as PVA (including hydrolyzed copolymers of vinyl esters, particularly hydrolyzed copolymers of vinyl acetate), cotton, viscose rayon, cuprammonium rayon and the like, and thermoplastics such as polyesters, polypropylene, polyethylene and the like. The preferred cellulosic-type fibers are rayon and polyvinyl alcohol. Webs containing 100% PVA fibers, 100% rayon fibers, and blends of PVA fibers and rayon fibers in the wt. % range of 1:100 to 100:1 are within the invention, and those webs having PVA:rayon within the weight range of 30:70 to about 70:30 are particularly preferred in this aspect of the invention, since the coated products exhibit good hydrophilicity, strength, and hand.

Some aspects of the nonwoven fiber web are common to all article embodiments of the invention. The fibers employed typically and preferably have denier ranging from about 0.5 to about 10 (about 0.06 to about 11 tex), although higher denier fibers may also be employed. Fibers having denier from about 0.5 to 3 (0.06 to about 3.33 tex) are particularly preferred. ("Denier" means weight in grams of 9000 meters of fiber, whereas "tex" means weight in grams per kilometer of fiber.) Fiber stock having a length ranging from about 0.5 to about 10 cm is preferably employed as a starting material, particularly fiber lengths ranging from about 3 to about 8 cm.

Nonwoven webs of fibers for use in the articles of the invention may be made using methods well documented in the nonwoven literature (see for example Turbak, A. "Nonwovens: An Advanced Tutorial", Tappi Press, Atlanta, Ga., (1989). The uncoated (i.e., before application of any binder) web should have a thickness in the range of about 10 to 100 mils (0.254 to 2.54 mm), preferably 30 to 70 mils (0.762 to 1.778 mm), more preferably 40 to 60 mils (1.02 to 1.524 mm). These preferred thicknesses may be achieved either by the carding/crosslapping operation or via fiber entanglement (e.g., hydroentanglement, needling, and the like). The basis weight of the uncoated web preferably ranges from about 50 $g/m^2$ up to about 250 $g/m^2$.

Binders within this aspect of the invention preferably are crosslinked via secondary hydroxyl groups on the PVA backbone with chelating organic titanates, and optionally with dialdehydes such as glyoxal. The resultant binder system will theoretically further react with hydroxyl groups on the fibers when cured at elevated temperatures to produce coated webs with excellent wiping properties.

Particularly preferred are "dual" crosslinked binders, wherein an amorphous metal oxide coordinates with silanol groups on the PVA backbone and titanates and/or glyoxal coordinate with secondary hydroxyl groups on the PVA backbone.

Silanol modified PVA's used in the present invention may be made via the copolymerization of any one of a number of ethylenically unsaturated monomers having hydrolyzable groups with an alkoxysilane-substituted ethylenenically unsaturated monomer. Examples of the former are vinyl acetate, acetoxyethyl acrylate, acetoxyethylmethacrylate, and various propyl acrylate and methacrylate esters. Examples of alkoxysilane-substituted ethylenenically unsaturated monomers include vinyl trialkoxysilanes such as vinyl trimethoxysilane and the like.

One particularly preferred silanol-modified PVA may be produced from the copolymerization of vinyl acetate and vinyl trialkoxysilane, followed by the direct hydrolysis of the copolymer in alkaline solution (see below). One commercially available product is that known under the trade designation "R1130" (Kuraray Chemical KK, Japan). This preferred base copolymer contains from about 0.5 to about 1.0 molar % of the silyl groups as vinylsilane units, a degree of polymerization of about 1700, and degree of hydrolysis of the vinyl acetate units preferably of 99+%.

The theoretical crosslink density may range from 1 to about 40 mole % based on mole of ethyleneically unsaturated monomer. This may be achieved by addition of one or more aqueous titanates and, optionally, dialdehyde/$NH_4Cl$ solutions to a polyvinyl alcohol binder resin. Though dialdehydes such as glyoxal and several classes of titanium complexes have been shown to crosslink aqueous compositions of polyvinyl alcohol, we have found that chelating titanates such as dihydroxybis(ammonium lactato) titanium (available under the trade designation "Tyzor LA" from du Pont) and titanium orthoesters such as Tyzor 131 provide excellent crosslinking for wiping articles described in this invention. It is desired that crosslinking be avoided until curing conditions (i.e., high temperatures) are present. Thus, organic acids, such as citric acid, may help to stabilize titanates such as dihydroxybis(ammonium lactato) titanium in aqueous compositions until the binder precursors are exposed to crosslinking and curing conditions.

To improve the tensile and tear strength of the inventive articles, and to reduce lint on the surface of the articles, it may be desirable to entangle (such as by needletacking, hydroentanglement, and the like) the uncoated web, or calender the uncoated and/or coated and cured nonwoven articles of the invention. Hydroentanglement may be employed in cases where fibers are water insoluble. Calendering of the binder coated web at temperatures from about 5 to about 40° C. below the melting point of the fiber may reduce the likelihood of lint attaching to the surface of the inventive articles and provide a smooth surface. Embossing of a textured pattern onto the wipe may be performed simultaneously with calendering, or in a subsequent step.

In addition to the above-mentioned components of the articles of this invention, it may also be desirable to add colorants (especially pigments), softeners (such as ethers and alcohols), fragrances, fillers (such as for example silica, alumina, and titanium dioxide particles), and bactericidal agents (for example iodine, quaternary ammonium salts, and the like) to add values and functions to the wiping articles described herein.

Coating of the binder resin may be accomplished by methods known in the art, including roll coating, spray coating, immersion coating, gravure coating, or transfer coating. The binder weight as a percentage of the total wiping article may be from about 1% to about 95%, preferably from about 10% to about 60%, more preferably 20 to 40%.

2. Articles Employing PVA-PA Blends as Binders

The absorbent nonwoven articles in accordance with this aspect of the invention comprise a nonwoven web of a plurality of organic fibers comprising polymers having a plurality of pendant hydroxyl groups, a major portion of the polymers being at least partially hydrolyzed polymerized monomers selected from the group consisting of monomers within the general formula

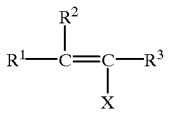

wherein X is $O(CO)R^7$ the provisos mentioned above. A binder coats at least a portion of the fibers, the binder consisting essentially of polyvinyl alcohol insolubilized with an effective amount of polyacrylic acid. Optionally, chemical crosslinking agents and/or bonding agents may also be employed.

The nonwoven web of fibers is substantially the same as that described in Section 1 above. Any fiber type, such as polyesters, polyolefins, cellulosics, acrylics, and the like, may be employed, alone or in combination. Preferably, the nonwoven web of fibers comprises one or more of the following fibers: cotton, viscose rayon, cuprammonium rayon, polyvinyl alcohols including hydrolyzed copolymers of vinyl esters, particularly hydrolyzed copolymers of vinyl acetate and the like. Preferred cellulosic-type fibers are rayon and polyvinyl alcohol. Blends of rayon and polyvinyl alcohol fibers in the weight ranges given above in Section 1 are preferred.

The fiber denier and length are also as previously described in Section 1 above, as well as the preferred ranges for uncoated web thickness and weight.

Coating of the binder resin may accomplished by the previously mentioned methods, including roll coating, spray coating, immersion coating, transfer coating, gravure coating, and the like. The binder weight as a percentage of the total nonwoven article weight for this aspect of the invention may range from about 5% to about 95%, preferably from about 10% to about 60%, more preferably 20 to 40%.

Polymeric polycarboxylic acids useful in the invention include polyacrylic acid, polymethacrylic acid, copolymers of acrylic acid, methacrylic acid or maleic acid containing more than 10% acidic monomer, provided that such copolymers or their salts are water soluble the specified pH levels; and vinyl methyl ether/maleic anhydride copolymer.

Polyacrylic acid, the most preferred polymeric polycarboxylic acid useful in the present invention preferably has a weight average molecular weight ranging from about 60,000 to about 3,000,000. More preferably, the weight average molecular weight of polyacrylic acid employed ranges from 300,000 to about 1,000,000.

Optionally, small amounts (i.e., less than about 5 wt. % of the total weight of binder) of additional monomers (such as, for example, functionalized acrylate monomers like hydroxyethylmethacrylate, vinyl azlactone monomers, and the like) may be incorporated in the PVA binder polymer to reduce binder washout during repeated use.

As with previously described embodiments, chemical crosslinkers may be used. Preferred crosslinkers are titanates, dialdehydes, borates, and the like.

The nonwoven articles of this aspect of the invention may be calendered as previously described in Section 1 to reduce lint on the surface of the article and provide a smooth surface for printing. Embossing of a textured pattern onto the wipe may be performed simultaneously with calendering, or in a subsequent step.

The above-mentioned optional components (colorants, softeners, fragrances, fillers) may also be employed in the nonwoven articles of this aspect of the invention.

3. Articles Employing Binders Comprising Syndiotactic PVA

Triad syndiotacticity, as used herein, means that of a triad of three pendant hydroxyl groups, the hydroxyl groups are positioned in an alternating pattern from side to side along the polymer chain. This is opposed to atactic, which means that the hydroxyl groups are randomly arranged, and isotactic, meaning the hydroxyl groups are positioned on the same side of the polymer chain.

Nonwoven absorbent articles within this aspect of the invention comprise a nonwoven web of fibers comprised of polymers having a plurality of pendant hydroxyl groups. The binder for articles within this aspect of the invention comprises polyvinyl alcohol having a syndiotacticity of at least 30%. Optionally, a chemical crosslinking agent may also be present.

The nonwoven web of fibers comprises fibers substantially the same as those described above as useful for the other articles of the invention. The fiber length and denier, and uncoated web thickness and weight are also as above-described in Section 1. Coating of the binder resin may be accomplished by the above-mentioned methods known in the art including roll coating, spray coating, immersion coating, transfer coating, gravure coating, and the like. The binder weight as a percentage of the total article weight for articles within this aspect of the invention may range from about 5% to about 95%, preferably from about 10% to about 60%, more preferably 20 to 40%.

For preparing syndiotactic PVA, vinyl trihaloacetoxy monomers are commonly employed, such as, vinyl trifluoroacetate, trifluoroacetoxyethyl acrylate, trifluoroacetoxyethyl methacrylate, and the like.

Polyvinyl trifluoroacetate is a preferred precursor ester for preparation of syndiotactic polyvinyl alcohol used in practice of the invention due to its high chemical reactivity making conversion to polyvinyl alcohol relatively facile. It may be hydrolyzed with alcoholic alkali, but is preferably hydrolyzed with methanolic ammonia (see Example 64 below). Polyvinyl trifluoroacetate is readily prepared by polymerization of vinyl trifluoroacetate.

Optionally, small amounts (i.e., less than about 5 wt. %) of additional monomers may be incorporated in the parent polymer to improve various properties of the polyvinyl alcohol derived therefrom. A particularly preferred syndiotactic PVA (and used in Examples 65–91 below) is hydrolyzed poly(vinyl trifluoroacetate-co-[3-allyl-2,2'-dihydroxy-4,4'-dimethoxybenzophenone]) (99.95:0.05 by weight, abbreviated as PVTFA). The triad syndiotacticity measured by $^1$H NMR was 51%, isotacticity=7%, atacticity=42%.

The syndiotacticity of the polyvinyl alcohol binder employed in this aspect of the invention typically and preferably ranges from about 45% to 100% syndiotacticity. It is known that increasing syndiotacticity at constant degree of polymerization results in increased melting point for the gel. (See Matsuzawa, S. et al., "Colloid Poly. Sci. 1981", 259(12), pp. 1147–1150.) For this reason higher syndiotacticity is preferred since mechanical strength and thermal stability are improved, but aqueous compositions of polyvinyl alcohol become more viscous and/or thixotropic as syndiotacticity increases due to gel formation. For these reasons, and owing to methods of preparation, the preferred range of syndiotacticity when coated from aqueous compositions preferably ranges from about 25 to about 65% syndiotacticity.

Although detrimental to the flexibility of the nonwoven articles of the invention, it may be advantageous to incorporate a small amount (e.g., up to about 10 mole %) of a chemical crosslinker such as those mentioned above in order to eliminate washout of the binder during use. Preferred crosslinkers are the above-mentioned titanates, with dialdehydes and the like being suitable but less preferred for ecological reasons.

The nonwoven articles of this aspect of the invention may be calendered at elevated temperature as above-described to reduce lint on the surface of the article and provide a smooth surface for printing. Embossing of a textured pattern onto the wipe may be performed simultaneously with calendering, or in a subsequent step. In addition, the above-mentioned colorants, softeners, fragrances, fillers, and the like may be employed.

4. Particularly Preferred Articles and Methods

Referring now to the drawing figures, FIG. 1 illustrates a perspective view of an absorbent nonwoven article 10 made in accordance with the invention. Article 10 has a plurality of fibers 12 at least partially coated with binder.

Figure 2:
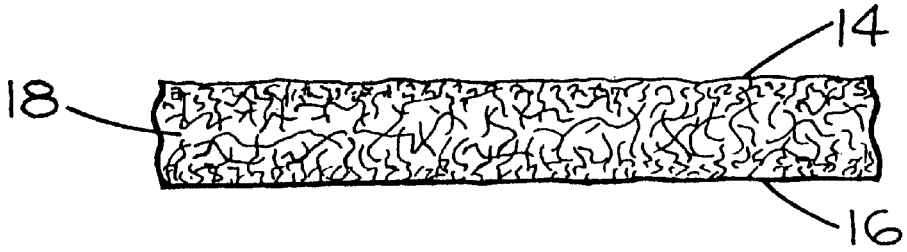
FIG. 2 is a cross-section along the lines 2—2 of the article of FIG. 1.

FIG. 2 is a cross-sectional view of the article of FIG. 1 taken through the section 2—2 of FIG. 1. FIG. 2 illustrates a preferred article wherein the major surfaces 14 and 16 (illustrated in exaggerated thickness) are comprise a combination of calendered and fused organic fibers and binder. Surfaces 14 and 16 form a sandwich with nonwoven material 18.

Figure 3:
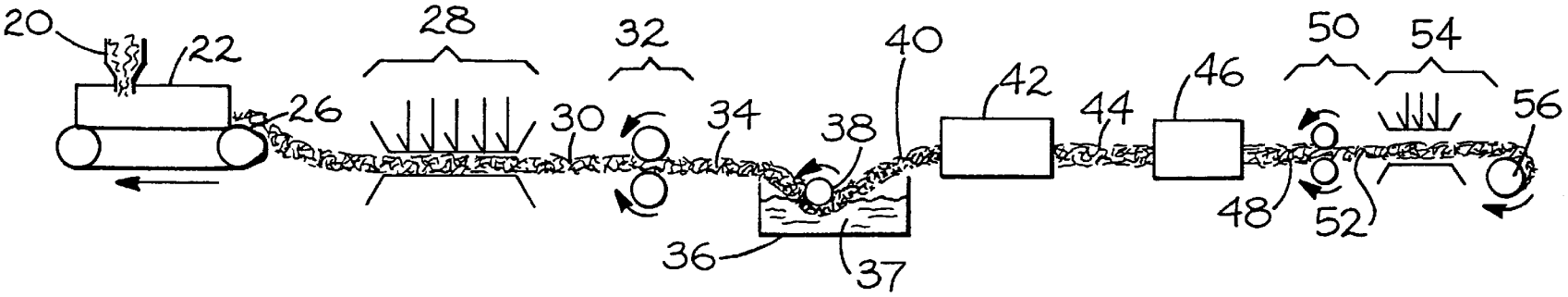
FIG. 3 is a schematic diagram of a preferred method of making articles of the invention.

FIG. 3 illustrates a preferred method of producing the nonwoven articles illustrated in FIGS. 1 and 2. Staple fibers are fed via a hopper 20 or other means into a carding station 22, such devices being well known and not requiring further explanation. A moving conveyer transports a carded web 26 from carding station 22, typically to a crosslapper, not shown, which forms a layered web having fibers at various angles to machine direction. Carded web 26 then typically and preferably passes through a needling station 28 to form a needled web 30 which is passed through calender station 32. At this point the calendered web 34 is not more than about 60 mils (1.524 mm) thick. Calendered web 34 then passes through an immersion bath 36 where an aqueous binder precursor composition 37 is applied. Web 34 passes under rollers 38 and emerges as a coated web 40, which then passes through a drying station 42 to form a dried web 44. Drying station 42 typically and preferably exposes the web to a temperature and for a residence time which allows substantially all of the water to be removed from the binder precursor to form a dried web 44.

Depending on the composition of the binder precursor, type of crosslinking and/or bonding agent used, amount of water present, etc., web 44 may be suitable for use without further curing. In some embodiments, it is desirable to pass dried web 44 through a final curing station 46, which is at a temperature higher than the temperature of drying station 42, to form a dried and cured web 48.

Web 48 may then be passed through another set of calender rollers 50, which may used to emboss a pattern, fuse the surfaces, and impart other qualities to the article. Web 52 generally has a thickness of no more than 60 mils (1.524 mm), and a weight ranging from about 50 g/m$^2$ to about 250 g/m$^2$.

Web 52 may then pass through a second needling station 54 to perforate the web for decorative or other purposes, after which the web is slit and wound onto take-up roll 56.

The features of the various aspects of the invention will be better understood in reference to the following Test Methods and Examples, wherein all parts and percentages are by weight. Names of ingredients in quotation marks indicate trade designations.

Test Methods

Tensile Strength

Tensile strength measurements were made on 1×3 inch (2.54×7.62 cm) wringer damp, die cut samples using an Instron Model "TM", essentially in accordance with ASTM test method D-5035. A constant rate of extension (CRE) was employed, and jaws were clamp-type. Rate of jaw separation was 9.3 inches/min. (23.6 cm/min).

Elmendorf Tear

Elmendorf tear tests were conducted on 2.5×11 inch (6.35×27.94 cm) damp, die-cut, notched (20 mm) samples, essentially in accordance with ASTM D-1424, using an Elmendorf Tear Tester model number 60-32, from Thwing-Albert Co., with a 3200 gram pendulum. An average of four measurements was used. A high value is desired.

Absorption

Absorption measurements were made on 6×8 inch (15.24×20.32 cm) samples which were die-cut in damp conditions. The absorption measurements are reported using the following terms:

(a) Dry Weight=the dried weight of the sample, in grams.

(b) No Drip Weight=the maximum total weight of the sample and water absorbed, in grams.

(c) With Drip Weight=the total weight of the sample, in grams, after dripping for 60 seconds.

(d) Damp Weight=the weight of the sample after passing through nip rollers.

(e) Wet Out=the time it takes for a droplet of water placed on the wipe surface to be completely absorbed into the sample.

(f) % Weight ($H_2O$) Loss=(No Drip Weight−With Drip Weight)/No Drip Weight.

(g) Grams Water Absorbed per Square foot (grams/929 $cm^2$)=3×(No Drip Weight−Dry Weight).

(h) Grams Water Absorbed per Gram Dry Weight=(No Drip Weight−Dry Weight)/Dry Weight.

(i) MD=machine direction, CD=cross direction, "abs"=absorbed, and "eff"=effective (j) effective water absorption=3×(no drip weight−damp weight).

Materials Description

The materials are used in the examples which follow:

"R1130" is the trade designation for a copolymer of vinyl silane and vinyl acetate containing from about 0.5 to about 1.0 molar % of the silyl groups as vinylsilane units, a degree of polymerization of about 1700, and degree of hydrolysis of the vinyl acetate units preferably of 99+% (Kuraray Chemical KK, Japan).

"Tyzor LA" is the trade designation for dihydroxybis (ammonium lactato) titanium (50 wt. % aqueous solution, available from du Pont Company, Du Pont Company), glyoxal (40 wt. % aqueous solution, Aldrich Chemicals) are then added to the silanol modified PVA solution at various proportions and combinations as described in the examples to follow.

"Tyzor 131" is the trade designation for a mixture of titanium orthoester complexes (20 wt. % aqueous solution, also available from DuPont.

"Nalco 8676" is the trade designation for a nanoscale, amorphous aluminum hydrous oxide colloid (10 wt. % aqueous solution), available from Nalco Chemical Company.

glyoxal is a dialdehyde of formula HCOCOH, available as a 40 wt. % aqueous solution from Aldrich Chemicals, Co.

"Airvol 165" is the trade designation for a 99.5+% hydrolyzed polyvinyl alcohol from Air Products and Chemicals, Inc.

EXAMPLES

General Procedure I for Preparing Inventive Articles

Nonwoven webs consisting of a blend of polyvinyl alcohol and rayon fibers (45% polyvinyl alcohol fiber having 1.5 denier and a length of 1.5 inch (3.81 cm) purchased from Kuraray, Japan, and 55% rayon fiber having 1.5 denier and a length of 1 and 9/16 inch (3.97 cm) purchased from BASF) were made using a web, making machine known under the trade designation "Rando-Webber". The resultant web had a nominal basis weight of 11.5 g/$ft^2$ (123.8 g/$m^2$) and an average thickness of 0.052 inch (0.132 cm).

Silanol modified polyvinyl alcohol granules ("R1130") were added to deionized water in proportions up to 10 wt. % solid in a stirred flask. The flask was then heated to 95° C. until reflux condition is achieved. The polymeric solution was then kept at reflux for a minimum of 45 minutes with adequate mixing. The solution was then cooled down to room temperature (about 25° C). The silanol modified PVA solution was then diluted to 2.5 wt. % solid. Reactants such as Nalco 8676, Tyzor LA, Tyzor 131, and glyoxal were then added to the silanol modified PVA solution at various proportions and combinations as described in the examples to follow.

A 12×15 inch (30.48×38.1 cm) piece of this nonwoven web was placed in a pan and saturated with approximately 200 g of an aqueous coating solution containing 5.00 g of total polymer.

Saturated samples were then dried and cured in a flow-through oven at various conditions to be described in the examples below. When curing was completed, the samples were conditioned for 60 minutes in 60–80° F. (140–176° C.) tap water then dried. Samples were then analyzed for hydrophilicity, water retention and absorption, tensile strength, tear strength, and dry wiping properties.

Examples 1–10 and Comparative Example A

The results of testing on Comparative Example A, a nonwoven wipe originally 59 mils (0.149 cm) thick, and known under the trade designation "Brittex-11" (available from Vileda, a division of Freudenberg Co., Germany, and which is a PVA web coated with a PVA binder crosslinked with formaldehyde) were as follows:

Wet Out=3 sec.;

% Water Loss=12.8;

Total Water Absorption=137.5 g/$ft^2$ (1479 g/$m^2$);

g of water absorbed/g of wipe=7.9;

tensile strength (machine direction)=273 lbs/$in^2$ (1882 KPa);

tensile strength (cross direction)=203 lbs/$in^2$ (1399 KPa);

Elmendorf Tear strength (machine direction and damp)=86;

Elmendorf Tear strength (cross direction and damp)=100+.

The test results for the inventive nonwovens of Examples 1–10 are presented in Tables 1 and 2. The nonwovens of Examples 1–10 were prepared as described in General Procedure I. For each example, 200 g of the polymeric solution (2.5 wt. % of R1130) was added with the reactants described below along with 0.1 g of Orcabrite Green BN 4009 pigment. The wt. % designated below represents the wt. % of active reactant (solid) over the R1130 polymer. The coated samples were dried at 150° F. (65.5° C.) for 2 hrs. then 250° F. (121.1° C.) for 2 hrs. and finally cured at 300° F. (148.8° C.) for 10 minutes. All samples had excellent dry wiping properties, low drag, and good feel.

TABLE 1

| Ex.# | Sample Description | Wet out (sec) | g H2O abs/g of Dry wipe | g H2O abs/($ft^2$) | % H2O Loss |
|---|---|---|---|---|---|
| 1 | Uncoated nonwoven substrate | 0 | 11.37 | 148.7 | 24.78 |
| 2 | COMPARATIVE R1130 | 0 | 8.90 | 158.6 | 18.55 |

TABLE 1-continued

| Ex.# | Sample Description | Wet out (sec) | g H2O abs/g of Dry wipe | g H2O abs/(ft$^2$) | % H2O Loss |
|---|---|---|---|---|---|
| 3 | R1130/0.5 wt. % Nalco 8676/5 wt. % Tyzor 131 | 0 | 8.37 | 159.7 | 17.2 |
| 4 | R1130/0.5 wt. % Nalco 8676/ 15 wt. % Tyzor 131 | 0 | 7.46 | 145.7 | 21.2 |
| 5 | R1130/0.5 wt. % Nalco 8676/5 wt. % Tyzor LA | 0 | 8.42 | 150.3 | 15.95 |
| 6 | R1130/0.5 wt. % Nalco 8676/15 wt. % Tyzor LA | 0 | 7.79 | 155.9 | 16.73 |
| 7 | R1130/5 wt. % Tyzor 131 | 0 | 8.26 | 145.5 | 15.71 |
| 8 | R1130/15 wt. % Tyzor 131 | 0 | 7.83 | 150.4 | 17.11 |
| 9 | R1130/5 wt. % Tyzor LA | 0 | 8.52 | 151.1 | 16.47 |
| 10 | R1130/15 wt. % Tyzor LA | 0 | 8.06 | 136.6 | 12.93 |

TABLE 2

| Ex.# | Sample Description | Tensile Strength (KPa) MD | Tensile Strength (KPa) CD | Elmendorf Tear MD | Elmendorf Tear CD |
|---|---|---|---|---|---|
| 1 | Uncoated nonwoven substrate COMPARATIVE | 1289 | 641 | 74.7 | 56.3 |
| 2 | R1120 | 2126 | 2011 | 85.5 | 93.0 |
| 3 | R1130/0.5 wt. % Nalco 8676/5 wt. % Tyzor 131 | 2555 | 2012 | 95.0 | 88.0 |
| 4 | R1130/0.5 wt. % Nalco 8676/15 wt. % Tyzor 131 | 2770 | 2032 | 86.3 | 100 |
| 5 | R1130/0.5 wt. % Nalco 8676/5 wt. % Tyzor LA | 2543 | 2001 | 76.7 | 85.0 |
| 6 | R1130/0.5 wt. % Nalco 8676/15 wt. % Tyzor LA | 2802 | 1921 | 90.3 | 100 |
| 7 | R1130/5 wt. % Tyzor 131 | 2481 | 2155 | 77.0 | 84.5 |
| 8 | R1130/15 wt. % Tyzor 131 | 2327 | 2201 | 90.8 | 84.0 |
| 9 | R1130/5 wt. % Tyzor LA | 2356 | 1787 | 80.3 | 82.5 |
| 10 | R1130/5 wt. % Tyzor LA | 2769 | 2090 | 78.0 | 87.5 |

Examples 11–20

The wipes of Example 11–20 were prepared as described in General Procedure I, and dried and cured as in Examples 1–10, except that the final 10 minute cure at 300° F. (121.1° C.) was eliminated. The absorbency, tensile strength and tear test results are presented in Tables 3 and 4.

It can be seen comparing the data of Tables 3 and 4 with the data of Tables 1 and 2 that addition of Tyzor LA or Tyzor 131, and the final 121.1° C. cure, gave immediate wet-out and consistently higher tensile strength and Elmendorf tear values.

TABLE 3

| Ex.# | Sample Description | Wet out (sec) | g H2O abs/g of dry wipe | g H2O abs/(ft$^2$) | % H2O Loss |
|---|---|---|---|---|---|
| 11 | R1130/0.5 wt. % Nalco 8676 | 28 | 8.87 | 152.8 | 17.7 |
| 12 | R1130/1 wt. % Nalco 8676 | 60+ | 7.80 | 141.5 | 14.09 |
| 13 | R1130/1.5 wt. % Nalco 8676 | 60+ | 7.65 | 141.7 | 13.99 |
| 14 | R1130/2.0 wt. % Nalco 8676 | 60+ | 7.48 | 138.7 | 14.92 |
| 15 | R1130/0.5 wt. % Nalco 8676/1 wt. % Tyzor LA | 0 | 8.35 | 160.7 | 19.60 |
| 16 | R1130/0.5 wt. % Nalco 8676/ 5 wt. % Tyzor LA | 0 | 8.49 | 161.5 | 19.70 |
| 17 | R1130/0.5 wt. % Nalco 8676/10 wt. % Tyzor LA | 0 | 8.31 | 155.6 | 16.57 |
| 18 | R1130/0.5 wt. % Nalco 8676/1 wt. % Tyzor 131 | 0 | 8.49 | 164.2 | 18.63 |
| 19 | R1130/0.5 wt. % Nalco 8676/5 wt. % Tyzor 131 | 0 | 8.12 | 165.0 | 19.69 |
| 20 | R1130/0.5 wt. % Nalco 8676/10 wt. % Tyzor 131 | 0 | 8.61 | 164.8 | 21.33 |

TABLE 4

| Ex.# | Sample Description | Tensile Strength (KPa) MD | Tensile Strength (KPa) CD | Elmendorf Tear MD | Elmendorf Tear CD |
|---|---|---|---|---|---|
| 11 | R1130/0.5 wt. % Nalco 8676 | 2218 | 2022 | 91.7 | 85.0 |
| 12 | R1130/1 wt. % Nalco 8676 | 2212 | 1856 | 88.8 | 100.0 |
| 13 | R1130/1.5 wt. % Nalco 8676 | 2678 | 1946 | 83.3 | 90.0 |
| 14 | R1130/2.0 wt. % Nalco 8676 | 2961 | 2164 | 86.3 | 100.0 |
| 15 | R1130/0.5 wt. % Nalco 8676/1 wt. % Tyzor LA | 2425 | 1783 | 78.3 | 100.0 |
| 16 | R1130/0.5 wt. % Nalco 8676/ 5 wt. % Tyzor LA | 2182 | 2086 | 74.5 | 100.0 |
| 17 | R1130/0.5 wt. % Nalco 8676/ 10 wt. % Tyzor LA | 2379 | 2130 | 100.0 | 95.0 |
| 18 | R1130/0.5 wt. % Nalco 8676/ 1 wt. % Tyzor 131 | 2390 | 1959 | 90.3 | 92.0 |
| 19 | R1130/0.5 Nalco 8676/ 5 wt. % Tyzor 131 | 2295 | 1904 | 85.0 | 100.0 |
| 20 | R1130/0.5 wt. % Nalco 8676/ 10 wt. % Tyzor 131 | 2419 | 1837 | 78.0 | 100.0 |

Examples 21–27

The inventive nonwovens of Examples 21–27 were prepared as described in General Procedure I. For each sample, 200 g of the polymeric solution (2.5 wt. % of R1130) was mixed with 1.54 g of glyoxal (40 wt. % aqueous solution) and 0.25 g of $NH_4Cl$ and then reacted with the reactants described below. The wt. % designated below represents the wt. % of active reactant (solid) over the R1130 polymer. The coated samples were dried at 110° F. (92.2° C.) for 4 hrs. All samples had excellent dry wiping properties, low drag, and good feel. The results of the absorbency, tensile strength, and tear strength are presented in Tables 5 and 6.

TABLE 5

| Ex.# | Sample Description | Wet out (sec) | g H2O abs/g of Dry wipe | g H2O abs/(ft$^2$) | % H2O Loss |
|---|---|---|---|---|---|
| 21 | NONE: COMPARATIVE | 0 | 7.40 | 127.9 | 15.27 |
| 22 | 1 wt. % Nalco 8676 | 60+ | 8.86 | 157.1 | 24.28 |
| 23 | 3 wt. % Nalco 8676 | 60+ | 9.39 | 162.9 | 26.12 |
| 24 | 5 wt. % Nalco 8676 | 60+ | 8.03 | 139.3 | 23.1O |
| 25 | 1 wt. % A12(SO4)3 (100% solid) | 31 | 8.25 | 148.7 | 19.70 |
| 26 | 3 wt. % A12(SO4)3(100% solid) | 16 | 8.53 | 153.8 | 21.92 |
| 27 | 5 wt. % A12(SO4)3(100% solid) | 60+ | 8.54 | 147.1 | 21.32 |

TABLE 6

| | | Tensile Strength (KPa) | | Elmendorf Tear | |
|---|---|---|---|---|---|
| Ex.# | Sample Description | MD | CD | MD | CD |
| 21 | NONE: COMPARATIVE | 1717 | 2616 | 100.0 | 86.3 |
| 22 | 1 wt. % Nalco 8676 | 1693 | 2639 | 94.0 | 94.3 |
| 23 | 3 wt. % Nalco 8676 | 2509 | 1915 | — | 91.0 |
| 24 | 5 wt. % Nalco 8676 | 2248 | 3230 | 100.0 | 90.3 |
| 25 | 1 wt. % A12(SO4)3 (100% solid) | 1880 | 2202 | 100.0 | 82.7 |
| 26 | 3 wt. % A12(SO4)3 (100% solid) | 1813 | 2273 | 100.0 | 85.0 |
| 27 | 5 wt. % A12(SO4)3 (100% solid) | 2449 | 2030 | 100.0 | 96.0 |

Examples 28–29

Examples 28–29 demonstrated the use of nonwoven web containing 100% PVA fibers. The nonwoven web was made from 100% PVA fibers which were 1.5 denier and 1.5 inch long (3.81 cm), purchased from Kuraray, Japan, with a basis weight of 7.0 g/ft$^2$ (75.3 g/m$^2$) using a carding machine known under the trade designation "Rando-Webber." A 12×15 inch (30.48×38.1 cm) sample of this web was coated with a solution containing: 130 g of R1130 solution (2.5 wt. % solid), 0.16 g of Nalco 8676 (10% solid), 1.63 g of Tyzor 131 (20 wt. % in water), and 0.16 g of Orcobrite Royal blue pigment #R2008. The coated sample was dried at 150° F. (65.5° C.) for 2 hrs. then cured at 300° F. (148.9° C.) for an additional 15 minutes. The coated sample had a rubbery feel. The absorbency and tensile strength data are presented in Tables 7 and 8.

TABLE 7

| Ex.# | Sample Description | Wet out (sec) | g H2O abs/g of dry wipe | g H2O abs/(ft$^2$) | % H2O Loss |
|---|---|---|---|---|---|
| 28 | Uncoated 100% PVA fiber web COMPARATIVE | 0 | 12.74 | 159.3 | 30.71 |
| 29 | Coated 100% PVA fiber web | 7 | 4.74 | 81.3 | 13.32 |

TABLE 8

| | | Tensile Strength (KPa) | |
|---|---|---|---|
| Ex.# | Sample Description | MD | CD |
| 28 | Uncoated 100% PVA fiber web COMPARATIVE | 1751 | 2042 |
| 29 | Coated 100% PVA fiber web | 2752 | 2352 |

Examples 30–31

Examples 30–31 demonstrated the use of a nonwoven web containing a blend of PVA and cotton fibers. The nonwoven web was made from 50 wt. % PVA fibers which were 1.5 denier and 1.5 inch (3.81 cm) in length, purchased from Kuraray, Japan, and 50 wt. % cotton fibers with a resultant basis weight of 5.5 g/ft$^2$ (59.2 g/m$^2$) using a web making machine known under the trade designation "Rando-Webber." A 12×15 inch (30.48×38.1 cm) sample of this web was coated with a solution containing: 110 g of R1130 solution (2.5 wt. % solid in $H_2O$), 0.13 g of Nalco 8676 (10% solid in $H_2O$), 1.38 g of Tyzor 131 (20% solid in $H_2O$), and 0.14 g of Orcobrite Royal blue pigment #R2008. The coated sample was dried at 150° F. (65.5° C.) for 2 hours, then cured at 300° F. (148.9° C.) for an additional 15 minutes. The coated sample had excellent dry wiping properties, low drag, and good feel. The absorbency and tensile strength data are presented in Tables 9 and 10.

TABLE 9

| Ex.# | Sample Description | Wet out (sec) | g H2O abs/g of Dry wipe | g H2O abs/(ft) | % H2O Loss |
|---|---|---|---|---|---|
| 30 | Uncoated 50/50 blend of PVA/Cotton fibers web: COMPARATIVE | 0 | 22.27 | 170.4 | 50.16 |
| 31 | Coated 50/50 blend of PVA/Cotton fibers web | 4 | 5.82 | 57.7 | 17.41 |

TABLE 10

| | | Tensile Strength (KPa) | |
|---|---|---|---|
| Ex.# | Sample Description | MD | CD |
| 30 | Uncoated 50/50 blend of PVA/Cotton fibers web: COMPARATIVE | 384 | 411 |

TABLE 10-continued

| Ex.# | Sample Description | Tensile Strength (KPa) MD | CD |
|---|---|---|---|
| 31 | Coated 50/50 blend of PVA/Cotton fibers web | 3689 | 2919 |

Example 32

The nonwoven web used in Example 32 was made from 100% rayon fibers which were 3.0 denier and 2.5 inches (6.35 cm) long from Courtalds Chemical Company, England, using a carding/crosslap/needletacking process. Its basis weight was 16.2 g/ft$^2$ (174.3 g/m$^2$). A 15×15 inch sample of this web (38.1×38.1 cm) was coated with a solution containing: 250 g of R1130 solution (2.5% solid in $H_2O$), 0.31 g of Nalco 8676 (10% solid in $H_2O$), 3.13 g of Tyzor 131 (20 wt. % in $H_2O$), and 0.4 g of Orcobrite Royal blue pigment #R2008. The coated sample was dried at 150° F. (65.5° C.) for 2 hours and then at 250° F. (121.1° C.) for 2 hours, and finally at 300° F. (148.8° C.) for an additional 10 minutes. The coated sample had excellent dry wiping properties, low drag, and soft feel.

Example 33

Example 33 demonstrated the preparation of a bactericidal wipe based on iodine and the polyvinyl alcohol/polyiodide complex. A solution of 1.2 g potassium iodide, 0.64 g iodine crystals, and 50 g of water was prepared. This solution was then saturated on a wipe prepared using the procedure of Example 5. Initially, a brown color was observed where the sample had been treated. The brown color gradually changed to blue color which is a characteristic of the polyvinyl alcohol/polyiodide complex. When rinsed with water, iodine color and odor were plainly evident.

General Procedure II for Preparing Inventive Articles

Nonwoven webs consisting a blend of polyvinyl alcohol and rayon fibers (45% polyvinyl alcohol fiber having a denier of 1.5 and a length of 1.5 inch (3.81 cm) purchased from Kuraray KK, and 55% rayon fiber having a denier of 1.5 and a length of 1 and 9/16 inch (3.97 cm) purchased from BASF) were made using a web making machine known under the trade designation Rando-Webber. The resultant web had an average dry weight of 12 g/ft$^2$ (129 g/m$^2$) and nominal thickness of 0.056 inch (0.142 cm).

An aqueous binder precursor solution was prepared for each example containing various amounts of Airvol 165 (a 99.8% hydrolyzed polyvinyl alcohol with molecular weight 110,000 and degree of polymerization 2500, obtained from Air Products) reacted with Tyzor LA and/or Tyzor 131 and optionally, glyoxal as described in Examples 34–47 and $NH_4Cl$, an acid catalyst. The binder precursor solutions also may have contained optional crosslinker(s) and pH modifiers as detailed in the Examples. A 12×15 inch (30.48×38.1 cm) piece of this nonwoven web was placed in a pan and saturated with approximately 200 g of an aqueous coating solution containing 5.00 g of total polymer.

Saturated samples were dried in a flow-through oven at 150° F. (65.5° C.), for between 30 minutes and 4 hours, and cured in a flow-through oven, preferably for greater than 10 minutes, at temperatures greater than 220° F. (104° C.). The samples were flipped every 10–30 minutes to aid in even drying conditions. When curing was completed, the samples were conditioned for 60 minutes in 60–80° F. (15.6–26.7° C.) tap water then dried. Samples were then analyzed for hydrophilicity, water retention and absorption, tensile strength, tear strength, and dry wiping properties.

Examples 34–38

Examples 34–38 illustrated the advantages of employing a titanate crosslinked PVA binder in wiping articles according to the invention. The wipes of Examples 34–38 were prepared as described in General Procedure II with the compositions described below at an initial coating weight of 5 g of polymeric material per 200 g solution and dried slowly at 150° F. (65.5° C.), followed by curing at 300° F. (148.9° C.). The absorbency, tensile strength, and tear data are presented in Tables 11 and 12, respectively.

TABLE 11

| Ex. # | Description | Wet Out (sec.) | % $H_2O$ Loss | g $H_2O$ abs./ft$^2$ | $H_2O$ Abs/Dry wgt. (g/g) | Eff g $H_2O$/ft$^2$ |
|---|---|---|---|---|---|---|
| 34 | Airvol 165 without Titanate | 0 | 20.49 | 157.62 | 8.20 | 116.22 |
| 35 | Airvol 165 with 5% Tyzor LA | 0 | 17.52 | 149.55 | 7.95 | 109.86 |
| 36 | Airvol 165 with 15% Tyzor LA | 0 | 13.10 | 142.83 | 7.51 | 101.49 |
| 37 | Airvol 165 with 5% Tyzor 131 | 0 | 18.89 | 144.96 | 7.77 | 106.56 |
| 38 | Airvol 165 with 15% Tyzor 131 | 0 | 15.79 | 133.47 | 7.21 | 96.06 |

TABLE 12

| Ex.# | Description | Av. Tensile Stress (KPa) Machine | Cross | Elmendorf Tear (Damp) Machine | Cross |
|---|---|---|---|---|---|
| 34 | Airvol 165 without Titanate | 2489 | 1999 | 100+ | 88 |
| 35 | Airvol 165 with 5% Tyzor LA | 2916 | 2330 | 100+ | 89 |
| 36 | Airvol 165 with 15% Tyzor LA | 2985 | 2489 | 83 | 96 |
| 37 | Airvol 165 with 5% Tyzor 131 | 2930 | 2296 | 86 | 93 |
| 38 | Airvol 165 with 15% Tyzor 131 | 3103 | 2530 | 75 | 68 |

Examples 39–45

Examples 39–45 illustrated the advantages of employing a titanate, and optionally, glyoxal crosslinked PVA binder in wiping articles according to the invention. The wipes of Examples 39–45 were prepared at an initial coating weight of 5 g total PVA, 1.59 g glyoxal, and 0.25 g $NH_4Cl$ per 200 g solution and dried slowly at 150° F. (65.5°). The absorbency, tensile strength, and tear data are presented in Tables 13 and 14, respectively.

TABLE 13

| Ex. # | Sample Description | Wet Out (sec.) | % $H_2O$ Loss | g $H_2O$ abs./ft$^2$ | $H_2O$ Abs/Dry wgt. (g/g) | Eff g $H_2O$/ft$^2$ |
|---|---|---|---|---|---|---|
| 39 | Airvol 165 with Glyoxal, NH4Cl, w/out Titanate | 1 | 14.47 | 125.37 | 7.42 | 88.11 |
| 40 | Airvol 165 with Glyoxal, NH4Cl, and 1% Tyzor LA | 1 | 14.91 | 124.62 | 7.39 | 87.81 |
| 41 | Airvol 165 with Glyoxal, NH4Cl, and 50% Tyzor LA | 1 | 14.65 | 128.88 | 7.34 | 92.64 |
| 42 | Airvol 165 with Glyoxal, NH4Cl, and 10% Tyzor LA | 1 | 14.75 | 130.53 | 7.35 | 93.33 |
| 43 | Airvol 165 with Glyoxal, NH4Cl, and 1% Tyzor 131 | 1 to 25 | 13.83 | 121.05 | 7.34 | 84.36 |
| 44 | Airvol 165 with Glyoxal, NH4Cl, and 5% Tyzor 131 | 1 to 20 | 15.27 | 128.61 | 7.48 | 91.23 |
| 45 | Airvol 165 with Glyoxal, NH4Cl, and 10% Tyzor 131 | 1 | 14.58 | 121.92 | 7.27 | 83.97 |

TABLE 14

| Ex.# | Description | PVA Retention | Avg. Tensile Stress (KPa) Machine | Avg. Tensile Stress (KPa) Cross | Elmendorf Tear (Damp) Machine | Elmendorf Tear (Damp) Cross |
|---|---|---|---|---|---|---|
| 39 | Airvol 165 with Glyoxal, NH4Cl, w/out Titanate | 80.5 | 2482 | 2255 | 98 | 100+ |
| 40 | Airvol 165 with Glyoxal, NH4Cl, and 1% Tyzor LA | 83 | 2709 | 2193 | 86 | 100 |
| 41 | Airvol 165 with Glyoxal, NH4Cl, and 5% Tyzor LA | 91.2 | 2592 | 2055 | 86 | 96 |
| 42 | Airvol 165 with Glyoxal, NH4Cl, and 10% Tyzor LA | 91.9 | 2758 | 2034 | 88 | 95 |
| 43 | Airvol 165 with Glyoxal NH4Cl, and 1% Tyzor 131 | 78.2 | 2696 | 2455 | 97 | 100+ |

TABLE 14-continued

| Ex.# | Description | PVA Retention | Avg. Tensile Stress (KPa) Machine | Avg. Tensile Stress (KPa) Cross | Elmendorf Tear (Damp) Machine | Elmendorf Tear (Damp) Cross |
|---|---|---|---|---|---|---|
| 44 | Airvol 165 with Glyoxal, NH4Cl, and 5% Tyzor 131 | 86.1 | 2772 | 2392 | 94 | 100+ |
| 45 | Airvol 165 with Glyoxal, NH4Cl, and 10% Tyzor 131 | 75.1 | 2558 | 2310 | 100+ | 100+ |

Example 46

Example 46 demonstrated the ability to color the wiping articles of this invention made in accordance with General Procedure II in varying colors and shades. A binder precursor solution was prepared consisting of 100 g 5 wt. % Airvol 165, 1.68 g Tyzor LA, 0.03 g, 0.06 g, 0.13 g, 0.25 g, or 0.5 g pigment dispersion, and deionized water to achieve a total solution weight of 200 g for each run. The binder precursor solution was coated onto a 12×15 inch (30.48 cm×38.1 cm) piece of PVA/rayon nonwoven produced as described in General Procedure II, dried at 120° F. (48.9° C.) for 2 hours, and finally cured for one hour at 140° F. (57.0° C.). Upon completion of run, the samples were conditioned for 60 minutes in 60–80° F. (140–176° C.) water and dried. Results are shown below.

| Pigment, Amount | Results |
|---|---|
| "Orcobrite Red BN", 0.03 to 0.5 g | Good color and fastness. |
| "Orcobrite Yellow 2GN", 0.03 to 0.5 g | Good color and fastness. |
| "Orcobrite Green BN", 0.03 to 0.5 g | Good color and fastness. |
| "Aqualor Green" | Good color, binder washout. |
| "Aqualor Blue" | Good color, binder washout. |

The aqueous pigment dispersions known under the trade designation "Aqualor" were obtained from Penn Color (Doylestown, Pa.), while those known under the trade designation Orcobrite aqueous pigment dispersions were obtained from Organic Dyestuffs (Concord, N.C.). Good results were obtained with a wide variety of the "Orcobrite" series of pigments. A major difference between the "Aqualor" and "Orcobrite" pigment dispersions, as supplied, was the substantially higher alkalinity of "Aqualor" pigment dispersions, perhaps leading to insufficient cure by the titanate crosslinking agent. Generally speaking it was found that the best results with regard to coloring were obtained at cure temperatures of 240–250° F. (115.6–121° C.), although higher temperatures were also useful.

Example 47

Example 47 demonstrated the ability to impregnate the synthetic wipes of the invention made in accordance with General Procedure II with a number of antibacterial, antifungal, and disinfecting solutions for use in the health care, business, and/or food service trades. A nonwoven produced in accordance with General Procedure II was saturated with an aqueous solution containing 1.2 g potassium iodide, 0.64 g solid iodine crystals, and 50 g deionized water.

Initially, a brown color was observed where the sample had been treated. The brown color gradually changed to blue, characteristic of the polyvinyl alcohol/polyiodide complex. When the article was rinsed with water, the iodine color and odor were plainly evident.

General Procedure III for Preparing Inventive Articles

A 12 by 15 inch (30.48×38.1 cm) piece of polyvinyl alcohol/rayon (45% polyvinyl alcohol fiber having a denier of 1.5 and a length of 1.5 inch (3.81 cm) purchased from Kuraray KK, and 55% rayon fiber having a denier of 1.5 and a length of 1 9/16 inch purchased from BASF) blended nonwoven fiber substrate (thickness=56 mil (0.142 cm), basis weight=11.5 g/ft$^2$ (123.8 g/m$^2$), prepared using a web marking of Rando-Webber) was placed in a pan and saturated with 200 g of an aqueous binder precursor solution containing 5.00 g total polyvinyl alcohol and polyacrylic acid, prepared by mixing a 5% aqueous solution of "Airvol 165" with a 2.5% aqueous solution of the polyacrylic acid. "Airvol 165" (a 99.8% hydrolyzed polyvinyl alcohol, MW=110,000, DP=2500 obtained from Air Products) was used in combination with polyacrylic acid (750,000 MW, Aldrich Chemical Co.). The binder precursor solution pH was adjusted with 85% phosphoric acid. The sample and tray were placed in a flow through drying oven at 120–150° F. (48.9–65.5° C.) for 2 hours followed by curing at 300° F. (148.9° C.) as specified in Table 15. The samples were flipped over after about 30 minutes and 60 minutes to aid in maintaining even drying. When curing was completed the samples were conditioned for 60 minutes in 60–80° F. water then dried.

Examples 48–62

Example wipes 48–62 were made in accordance with General Procedure III at the conditions specified in Table 15, and subsequently analyzed for wet out, absorptivity, tensile strength, tear strength, and dry wiping properties. The test results are presented in Tables 16–17. Examples 48–62 each contained 0.1 g "Orcobrite Yellow 2GN 9000" (a yellow pigment, available from Organic Dyestuffs, Corp.).

TABLE 15

| Ex.# | Description | Cure Conditions | % Coating Loss During Conditioning | Conditioned Coat Wt. (g/m$^2$) |
|---|---|---|---|---|
| 48 | Polyacrylic Acid, pH = 3.0, COMPARATIVE | 2 HR 120° F. (48.9° C.)/ 5 MIN 300° F. (148.9° C.) | 4 | 40.5 |
| 49 | Airvol 165 (polyvinyl alcohol), pH = 3.0, COMPARATIVE | 2 HR 120° F. (48.9° C.)/ 5 MIN 300° F. (148.9° C.) | 1 | 48.4 |
| 50 | 1 part Polyacrylic acid/ 2 parts Airvol 165, pH = 3.0 | 2 HR 120° F. (48.9° C.)/ 5 MIN 300° F. (148.9° C.) | 0 | 49.5 |
| 51 | 1 part Polyacrylic acid/ 3 parts Airvol 165, pH = 3.0 | 2 HR 120° F. (48.9° C.)/ 5 MIN 300° F. (148.9° C.) | 0 | 48.2 |
| 52 | 1 part Polyacrylic acid/ 5 parts Airvol 165, pH = 3.0 | 2 HR 120° F. (48. 9° C.)/ 5 MIN 300° F. (148.9° C.) | 0 | 56.9 |
| 53 | 1 part Polyacrylic acid/ 10 parts Airvol 165, pH = 3.0 | 2 HR 120° F. (48.9° C.)/ 5 MIN 300° F. (148.9° C.) | 0 | 58.5 |
| 54 | 1 part Polyacrylic acid/ 99 parts Airvol 165, pH = 3.5 | 2 HR 150° F. (65.6° C.)/ 5 MIN 300° F. (148.9° C.) | 0 | 52.4 |
| 55 | 1 part Polyacrylic acid/ 99 parts Airvol 165, pH = 3.5 | 2 HR 150° F. (65.6° C.)/ 15 MIN 300° F. (148.9° C.) | 0 | 51.6 |
| 56 | 1 part Polyacrylic acid/ 99 parts Airvol 165, pH = 3.5 | 2 HR 150° F. (65.6° C.)/ 25 MIN 300° F. (148.9° C.) | 0 | 55.4 |
| 57 | 0.1 part Polyacrylic acid/ 99 parts Airvol 165, pH = 3.5 | 2 HR 150° F. (65.6° C.)/ 5 MIN 300° F. (148.9° C.) | 1 | 49.5 |
| 58 | 0.5 part Polyacrylic acid/ 99 parts Airvol 165, pH = 3.5 | 2 HR 150° F. (65. 6° C.)/ 5 MIN 300° F. (148.9° C.) | 1 | 53.5 |
| 59 | 1 part Polyacrylic acid/ 99 parts Airvol 165, pH = 3.5 | 2 HR 150° F. (65.6° C.)/ 5 MIN 300° F. (148.9° C.) | 0 | 55.4 |
| 60 | 1 part Polyacrylic acid/ 99 parts Airvol 165, pH = 4.0 | 2 HR 150° F. (65.6° C.)/ 5 MIN 300° F. (148.9° C.) | 0 | 49.7 |
| 61 | 1 part Polyacrylic acid/ 99 parts Airvol 165, pH = 4.6 | 2 HR 150° F. (65.6° C.)/ 5 MIN 300° F. (148.9° C.) | 0 | 52.3 |
| 62 | 1 part Polyacrylic acid/ 99 parts Airvol 165, pH = 3.3 | 2 HR 150° F. (65.6° C.)/ 5 MIN 300° F. (148.9° C.) | 1 | 48.3 |

TABLE 16

| Ex. # | Tensile Strength Machine Direction (KPa) | Tensile Strength Cross Web Direction (KPa) | Elmendorf Tear Test (Machine Direction) | Elmendorf Tear Test (Cross Web Direction) | % $H_2O$ Loss |
|---|---|---|---|---|---|
| 48 | 1910 | 1014 | 65 | 73 | 11 |
| 49 | 3054 | 2240 | 53 | 90 | 11 |
| 50 | 2937 | 2420 | 54 | 100+ | 10 |
| 51 | 3296 | 2117 | 74 | 86 | 11 |
| 52 | 2379 | 1751 | 87 | 100+ | 11 |
| 53 | 2779 | 1813 | 81 | 82 | 13 |
| 54 | 2772 | 2737 | 96 | 100+ | 18 |
| 55 | 2958 | 2565 | 77 | 100+ | 20 |

TABLE 16-continued

| Ex. # | Tensile Strength Machine Direction (KPa) | Tensile Strength Cross Web Direction (KPa) | Elmendorf Tear Test (Machine Direction) | Elmendorf Tear Test (Cross Web Direction) | % $H_2O$ Loss |
|---|---|---|---|---|---|
| 56 | 2854 | 2399 | 79 | 90 | 21 |
| 57 | 2758 | 2365 | 91 | 100+ | 16 |
| 58 | 2523 | 2324 | 88 | 100+ | 18 |
| 59 | 2723 | 2461 | 85 | 100+ | 20 |
| 60 | 2737 | 2392 | 89 | 100+ | 22 |
| 61 | 2785 | 2358 | 87 | 100+ | 22 |
| 62 | 2909 | 2275 | 90 | 100+ | 19 |

TABLE 17

| Ex. # | Total $H_2O$ Abs. ($g/ft^2$) | $H_2O$ Abs./Dry Wt. (g/g) | Eff. $H_2O$ Abs. ($g/ft^2$) |
|---|---|---|---|
| 48 | 175.7 | 9.70 | 105.2 |
| 49 | 137.7 | 7.70 | 98.9 |
| 50 | 142.7 | 7.63 | 101.1 |
| 51 | 139.4 | 7.27 | 94.5 |
| 52 | 126.2 | 6.13 | 84.9 |
| 53 | 136.3 | 6.67 | 96.3 |
| 54 | 158.7 | 7.78 | 114.0 |
| 55 | 157.0 | 8.03 | 111.4 |
| 56 | 156.0 | 7.46 | 111.1 |
| 57 | 148.6 | 7.41 | 105.0 |
| 58 | 159.7 | 7.86 | 115.3 |
| 59 | 160.9 | 6.31 | 116.7 |
| 60 | 158.7 | 8.55 | 116.1 |
| 61 | 162.1 | 8.21 | 118.3 |
| 62 | 150.8 | 7.76 | 108.7 |

Example 63

This example demonstrated the preparation of a bactericidal wipe based on iodine and a polyvinyl alcohol/polyiodide complex, and made in accordance with General Procedure III. A solution of 1.2 g potassium iodide, 0.64 g iodine crystals, and 50 g water was prepared. This solution was coated onto a sample of 1:2 polyacrylic acid/polyvinyl alcohol wipe prepared as in General Procedure III above. Initially, a brown color was observed where the sample had been treated. The brown color gradually changed to blue characteristic of the polyvinyl alcohol/polyiodide complex. When rinsed with water iodine color and odor were plainly evident.

General Procedure IV for Preparing Inventive Articles

A 12 by 15 inch (30.48×38.1 cm) piece of polyvinyl alcohol/rayon (45% polyvinyl alcohol fiber having a denier of 1.5 and a length of 1.5 in (3.81 cm) purchased from Kuraray KK, and 55% rayon fiber having a denier of 1.5 and a length of 1.56 inch (3.96 cm) purchased from BASF) blended nonwoven fiber substrate (thickness=56 mil (0.142 cm), basis weight 11.5 $g/ft^2$ (123.8 $g/cm^2$), prepared using a web making machine known under the trade designation "Rando-Webber") was placed in a pan and saturated with 200 g of an aqueous binder precursor solution containing 5.00 g total polyvinyl alcohol. "Airvol 165" (a 99.8% hydrolyzed polyvinyl alcohol, MW=110,000, DP=2500 obtained from Air Products) was used in combination with syndiotactic polyvinyl alcohol prepared in Example 64 to comprise the polyvinyl alcohol content in Examples 65–91. The binder precursor solutions may also have contained optional crosslinker(s), and pH modifiers depending on the Example. The sample and tray were placed in a flow through drying oven at 120–50° F. (48.9–65.6° C.) for 3 to 4 hours as specified. The samples were flipped over after about 30 minutes and 60 minutes to aid in maintaining even drying. When curing was completed the samples were conditioned for 60 minutes in 60–80° F. (15.6–26.7° C.) water then dried. Samples were then analyzed for wet out, absorptivity, tensile strength, tear strength, and dry wiping properties, with the results reported in Tables 18–27.

Example 64

Preparation of Syndiotactic PVA

This example illustrated the preparation of syndiotactic polyvinyl alcohol employed in Examples 65–91.

The polyvinyl trifluoroacetate (PVTFA) copolymer described above (300 g) was dissolved in 700 g acetone. This solution was slowly added to 1700 g of 10% methanolic ammonia that had been cooled in ice to 15° C. Despite vigorous mechanical stirring a large ball of solid material formed on the stirrer blade making stirring ineffective. After addition was complete the ball of material was broken up by hand and the mixture was shaken vigorously. The process was repeated twice more (elapsed time was about 3 hr). The divided mass was vigorously mechanically stirred for 20 minutes and allowed to stand at room temperature overnight.

The supernatant liquid was decanted off leaving a mixture of white powder and yellow fibrils. The solids were collected by filtration and spread in a tray at 15.6° C. to evaporate residual solvent. The solids were collected when constant weight over 2 hr was achieved. The solid was chopped in a blender to give 87.3 g of beige powder, 92% yield, referred to hereinafter as "Syn". Analysis of this material was carried out using IR and $^1H$ NMR spectroscopy, and Gel Permeation Chromatography. The results indicated the likely presence of traces of trifluoroacetate esters and salts. The triad syndiotacticity measured by $^1H$ NMR in DMSO-$d_6$ was 33%, atacticity=50%, isotacticity=17%, The difference between the hydrolyzed polymer and the trifluoroacetate precursor polymer may be due to acid catalyzed epimerization of hydroxyl groups during drying or solution in boiling water.

Examples 65–70

Examples 65–70 illustrated the advantages of employing syndiotactic polyvinyl alcohol alone or in blends with atactic polyvinyl alcohol in wiping articles according to the invention. The articles were prepared at an initial coating weight of 5 g total PVA/200 g solution. Curing conditions were 4 hr at 48.9° C.

TABLE 18

| Ex. # | Description | Tensile Strength Machine Direction (KPa) | Tensile Strength Cross Direction (KPa) | % Coating Weight Loss During Conditioning | Elmendorf Tear Machine Direction | Elmendorf Tear Cross Direction |
|---|---|---|---|---|---|---|
| 65 | 100% AIRVOL 165 | 2061 | 1131 | 10.1 | 63(5) | 95(7) |
| 66 | 99% AIRVOL 165:1% Syn | 2186 | 1496 | 8.9 | 79(2) | 100+ |
| 67 | 95% AIRVOL 165:5% Syn | 2027 | 1427 | 8.4 | 74(7) | 89(0) |

TABLE 18-continued

| Ex. # | Description | Tensile Strength Machine Direction (KPa) | Tensile Strength Cross Direction (KPa) | % Coating Weight Loss During Conditioning | Elmendorf Tear Machine Direction | Elmendorf Tear Cross Direction |
|---|---|---|---|---|---|---|
| 68 | 90% AIRVOL 165:10% Syn | 2475 | 1799 | 7.8 | 75(4) | 86(7) |
| 69 | 80% AIRVOL 165:20% Syn | 2109 | 1510 | 6.2 | 100+ | 95(4) |
| 70 | 100% Syn | 2661 | 1979 | 5.5 | 100+ | 91(0) |

TABLE 19

| Ex. # | Description | Wet Out (sec) | % Water Loss | Total Water Absorption ($g/ft^2$) | Water Absorption/ Dry wt. of Sample (g/g) | Effective Water Absorption ($g/ft^2$) |
|---|---|---|---|---|---|---|
| 65 | 100% AIRVOL 165 | 0 | 17.4 | 134.52 | 7.92 | 99.60 |
| 66 | 99% AIRVOL 165:1% Syn | 0 | 20.0 | 150.09 | 8.38 | 112.50 |
| 67 | 95% AIRVOL 165:5% Syn | 0 | 15.0 | 136.17 | 7.81 | 99.90 |
| 68 | 90% AIRVOL 165:10% Syn | 0 | 14.8 | 130.50 | 7.63 | 95.40 |
| 69 | 80% AIRVOL 165:20% Syn | 0 | 15.8 | 131.58 | 7.14 | 94.80 |
| 70 | 100% Syn | 2 | 16.8 | 143.25 | 7.33 | 106.71 |

Examples 71–83

These examples demonstrated the use of syndiotactic polyvinyl alcohol with chemical crosslinkers (Tyzor LA and/or glyoxal) in wiping articles according to the invention. Curing conditions were 3.5 hr at 150° F. (65.5° C.). Mole % crosslinking amounts for Tyzor LA were based on four bonds between titanium and polyvinyl alcohol. Mole % crosslinking amounts for glyoxal were based on four bonds between glyoxal and polyvinyl alcohol.

TABLE 20

| Ex. # | Description | Wet Out (sec) | % Water Loss | Total Water Absorption ($g/ft^2$) | Water Absorption/ Dry wt. of Sample (g/g) | Effective Water Absorption ($g/ft^2$) |
|---|---|---|---|---|---|---|
| 71 | 1% Blend of Syn in Airvol 165 with 20 mol % Tyzor LA crosslinking | 0 | 25.1 | 129.2 | 8.65 | 119.49 |

TABLE 20-continued

| Ex. # | Description | Wet Out (sec) | % Water Loss | Total Water Absorption ($g/ft^2$) | Water Absorption/ Dry wt. of Sample (g/g) | Effective Water Absorption ($g/ft^2$) |
|---|---|---|---|---|---|---|
| 72 | 1% Blend of Syn in Airvol 165 with 20 mol % Tyzor LA crosslinking | 0 | 20.1 | 137.4 | 8.12 | 117.36 |
| 73 | 5% Blend of Syn in Airvol 165 with 20 mol % Tyzor LA crosslinking | 0 | 16.9 | 134.7 | 7.71 | 106.92 |
| 74 | 5% Blend of syn in Airvol 165 with 20 mol % Tyzor LA crosslinking | 0 | 17.8 | 135.2 | 7.62 | 108.00 |
| 75 | 10% Blend of Syn in Airvol 165 with 20 mol % Tyzor LA crosslinking | 0 | 21.7 | 128.4 | 7.96 | 110.29 |

TABLE 21

| Ex. # | Description | Wet Out (sec) | % Water Loss | Total Water Absorption ($g/ft^2$) | Water Absorption/ Dry wt. of Sample (g/g) | Effective Water Absorption ($g/ft^2$) |
|---|---|---|---|---|---|---|
| 76 | 10% Blend of Syn in Airvol 165 with 20 mol % Tyzor LA crosslinking | 0 | 18.2 | 133.8 | 7.70 | 108.2 |
| 77 | 1% Blend of Syn in Airvol 165 with 40 mol % Glyoxal crosslinking | 0 | 15.6 | 137.8 | 8.42 | 107.7 |
| 78 | 1% Blend of Syndiotactic in Airvol 165 with 40 mol % Glyoxal crosslinking | 0 | 17 | 139.4 | 8.58 | 111.4 |
| 79 | 5% Blend of Syndiotactic in Airvol 165 with 40 mol % Glyoxal crosslinking | 0 | 15.8 | 145.4 | 8.35 | 114.7 |
| 80 | 5% Blend of Syndiotactic in Airvol 165 with 40 mol % Glyoxal crosslinking | 0 | 17.3 | 139.7 | 8.80 | 113.3 |
| 81 | 10% Blend of Syndiotactic in Airvol 165 with 40 mol % Glyoxal crosslinking | 0 | 11.2 | 144.5 | 8.40 | 107.1 |
| 82 | 10% Blend of Syndiotactic in Airvol 165 with 40 mol % Glyoxal crosslinking | 0 | 16.9 | 154.8 | 8.30 | 122.3 |

TABLE 21-continued

| Ex. # | Description | Wet Out (sec) | % Water Loss | Total Water Absorption ($g/ft^2$) | Water Absorption/ Dry wt. of Sample (g/g) | Effective Water Absorption ($g/ft^2$) |
|---|---|---|---|---|---|---|
| 83 | 10% Blend of Syndiotactic in Airvol 165 | 0 | 13.1 | 141.9 | 7.46 | 105.2 |

TABLE 22

| Ex.# | Description | Tensile Strength Machine Direction (KPa) | Tensile Strength Cross Direction (KPa) | % Coating Weight Loss During Conditioning |
|---|---|---|---|---|
| 71 | 1% Blend of Syn in Airvol 165 with 20 mol % Tyzor LA crosslinking | 2158 | 2082 | 4.3 |
| 72 | 1% Blend of Syn in Airvol 165 with 20 mol % Tyzor LA crosslinking | 2971 | 1724 | 4.2 |
| 73 | 5% Blend of Syn in Airvol 165 with 20 mol 5 Tyzor LA crosslinking | 2572 | 2199 | 4.4 |
| 74 | 5% Blend of Syn in Airvol 165 with 20 mol % Tyzor LA crosslinking | 2737 | 1979 | 4.5 |

TABLE 23

| Ex.# | Description | Tensile Strength Machine Direction (KPa) | Tensile Strength Cross Direction (KPa) | % Coating Weight Loss During Conditioning |
|---|---|---|---|---|
| 75 | 10% Blend of Syn in Airvol 165 with 20 mol % Tyzor LR crosslinking | 2475 | 1944 | 5.1 |

TABLE 23-continued

| Ex.# | Description | Tensile Strength Machine Direction (KPa) | Tensile Strength Cross Direction (KPa) | % Coating Weight Loss During Conditioning |
|---|---|---|---|---|
| 76 | 10% Blend of syn in Airvol 165 with 20 mol % Tyzor LR crosslinking | 2910 | 2240 | 4.8 |
| 77 | 1% Blend of syn in Airvol 165 with 40 mol % Glyoxal crosslinking | 2820 | 1889 | 3.3 |
| 78 | 1% Blend of Syndiotactic in Airvol 165 with 40 mol % Glyoxal crosslinking | 2351 | — | 3.5 |
| 79 | 5% Blend of Syndiotactic in Airvol 165 with 40 mol % Glyoxal crosslinking | 2482 | 2006 | 3.2 |
| 80 | 5% Blend of Syndiotactic in Airvol 165 with 40 mol % Glyoxal crosslinking | 2199 | 1841 | 3.5 |
| 81 | 10% Blend of Syndiotactic in Airvol 165 with 40 mol % Glyoxal crosslinking | 2227 | 1696 | 3.5 |
| 82 | 10% Blend of Syndiotactic in Airvol 165 with 40 mol % glyoxal crosslinking | 2379 | 1786 | 3.0 |
| 83 | 10% Blend of Syndiotactic in Airvol 165 | 2365 | 1696 | 1.8 |

Examples 84–86

Examples 84–86 demonstrated the effect of coat weight on wiping parameters of articles made in accordance with General Procedure IV. A binder precursor solution consisting only of 30% syndiotactic PVA was coated onto nonwoven substrates at various coating weights (i.e., 1 g, 2 g, 5 g total PVA in coating solution) as indicated in Tables 24 and 25, which also present the absorbency and strength test results.

TABLE 24

| Ex. # | Description | Tensile Strength Machine Direction (KPa) | Tensile Strength Cross Direction (KPa) | % Weight Loss During Conditioning | Elmendorf Tear Machine Direction | Elmendorf Tear Cross Direction |
|---|---|---|---|---|---|---|
| 84 | 5 g:100% Syn | 2661 ± 117 | 1979 ± 69 | 5.5 | 100+ | 91 ± 0 |
| 85 | 2 g:100% Syn | 2006 ± 131 | 1351 ± 34 | 3.3 | 75 ± 6 | 96 ± 2 |

TABLE 24-continued

| Ex. # | Description | Tensile Strength Machine Direction (KPa) | Tensile Strength Cross Direction (KPa) | % Weight Loss During Condition-ing | Elmendorf Tear Machine Direction | Elmendorf Tear Cross Direct-ion |
|---|---|---|---|---|---|---|
| 86 | 1 g:100% syn | 1441 ± 138 | 1186 ± 89 | 2.9 | 84 ± 9 | 100+ |

TABLE 25

| Ex. # | Description | Wet Out (sec) | % Wa-ter Loss | Total Water Absorp-tion (g/ft$^2$) | Water Absorption/ Dry wt. of Sample (g/g) | Effective Water Absorp-tion (g/ft$^2$) |
|---|---|---|---|---|---|---|
| 84 | 5 g:100% Syn | 2 | 16.8 | 143.25 | 7.33 | 106.71 |
| 85 | 2 g:100% Syn | 0 | 18.2 | 146.31 | 8.31 | 116.40 |
| 86 | 1 g:100% Syn | 0 | 20.5 | 157.68 | 10.43 | 127.62 |

Examples 87–89

Examples 87–89 demonstrated the results of direct ammonolysis of polyvinyl trifluoroacetate after the binder precursor solutions was coated on the nonwoven substrate. The absorbency and strength of these articles (Tables 26 and 27) were superior to those of 30% syndiotactic polyvinyl alcohol coated from water described in the preceding examples. One explanation of the benefits observed is that acid catalyzed loss of syndiotacticity was minimized by use of this method which probably provided greater surface area for ammonolysis.

TABLE 26

| Ex.# | Description | Tensile Strength Machine Direction (KPa) | Tensile strength Cross Direction (KPa) | % Weight Loss During Conditioning |
|---|---|---|---|---|
| 87 | 16 g PVTFA/ammonolyzed (5 g PVA) | 3744 | 3041 | 0 |
| 88 | 6.5 g PVTFA/ammonolyzed (2 g PVA) | 2544 | 2082 | 0 |
| 89 | 3.2 g PVTFA/ammonolyzed (1 g PVA) | 1551 | 1165 | 0 |

TABLE 27

| Ex. # | Description | Wet Out (sec) | % Wa-ter Loss | Total Water Ab-sorption (g/ft$^2$) | Water Absorp-tion/ Dry wt of Sample (g/g) | Effective Water Absorp-tion (g/ft$^2$) |
|---|---|---|---|---|---|---|
| 87 | 16 g PVTFA/ ammonolyzed (5 g PVA) | 0 | 22.5 | 114.4 | 5.86 | 81.5 |

TABLE 27-continued

| Ex. # | Description | Wet Out (sec) | % Wa-ter Loss | Total Water Ab-sorption (g/ft$^2$) | Water Absorp-tion/ Dry wt of Sample (g/g) | Effective Water Absorp-tion (g/ft$^2$) |
|---|---|---|---|---|---|---|
| 88 | 6.5 g PVTFA/ ammonolyzed (2 g PVA) | 0 | 23.0 | 143.2 | 7.90 | 107.6 |
| 89 | 3.2 g PVTFA/ ammonolyzed (1 g PVA) | 0 | 30.1 | 166.2 | 9.82 | 134.1 |

Example 90

This example demonstrated the preparation of a bactericidal wipe based on iodine and the polyvinyl alcohol/polyiodide complex utilizing General Procedure IV. A solution of 1.2 g potassium iodide, 0.64 g iodine crystals, and 50 g water was prepared. This solution was coated onto a sample of a wipe as prepared in Examples 84–86. Initially, a brown color was observed where the sample had been treated. The brown color gradually changed to blue characteristic of the polyvinyl alcohol/polyiodide complex. When rinsed with water iodine color and odor were plainly evident.

Example 91

A sample containing 5 g 30% syndiotactic PVA as the only binder component in 200 g total solution was prepared and coated as in Examples 84–86 containing 0.1 g "Orcobrite Blue 2GN" pigment (Organic Dyestuffs Corp., Concord, N.C.). The sample was cured at 250° F. (121° C.) for 2 hours. The sample discolored slightly and had a strong odor, but was colorfast after conditioning in luke-warm water for 2 hours.

Various modifications and alterations of this invention will become apparent to those skilled in the art without departing from the scope of the invention, and it should be understood that this invention is not to be unduly limited to the illustrated embodiments set forth herein.

What is claimed is:

1. An absorbent nonwoven article comprising:

(a) a nonwoven web comprised of polyvinyl alcohol fibers; and (b) a binder coated on at least a portion of said fibers, said binder comprising syndiotactic polyvinyl alcohol having a plurality of hydroxyl groups, said syndiotactic polyvinyl alcohol having a triad syndiotacticity of said hydroxyl groups of at least 30%.

2. An absorbent article in accordance with claim 1 wherein said binder comprises unhydrolyzed polymers derived from monomers selected from the group consisting of monomers within the general formula

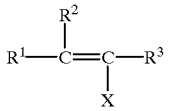

wherein:

X is selected from the group consisting of $Si(OR^4OR^5OR^6)$ and $OCOR^7$; and $R^1$–$R^7$ inclusive are independently selected from the group consisting of hydrogen and organic radicals having from 1 to about 10 carbon atoms, inclusive, and combinations thereof.

3. An absorbent article in accordance with claim 1 wherein said syndiotactic polyvinyl alcohol is bonded to at least a portion of said polyvinyl alcohol fibers through bonds between said pendant hydroxyl groups on said fibers, a bonding agent, and said pendant hydroxyl groups on said syndiotactic polyvinyl alcohol.

4. An absorbent article in accordance with claim 1 wherein said syndiotactic polyvinyl alcohol is at least partially crosslinked by a crosslinking agent.

5. An absorbent article in accordance with claim 3 wherein said syndiotactic polyvinyl alcohol is at least partially crosslinked by a crosslinking agent.

6. An absorbent article in accordance with claim 5 wherein said crosslinking agent and said bonding agent are the same.

7. An absorbent article in accordance with claim 1 wherein said web further comprises fibers selected from the group of cotton, viscose rayon, cuprammonium rayon, polyesters, polypropylene, and combinations thereof.

8. An absorbent article in accordance with claim 1 wherein the polyvinyl alcohol has a syndiotacticity within the range from about 45% to about 100%.

9. An absorbent article in accordance with claim 3 wherein the bonding agent is selected from the group consisting of organic titanates and dialdehydes.

10. An absorbent article in accordance with claim 4 wherein the crosslinking agent is selected from the group consisting of organic titanates and dialdehydes.

11. An absorbent article in accordance with claim 5 wherein the crosslinking agent is selected from the group consisting of organic titanates and dialdehydes.

12. An absorbent article in accordance with claim 7 wherein the nonwoven web further comprises rayon fibers and has a ratio of polyvinyl alcohol fibers to rayon fibers within a weight range of about 30:70 to about 70:30.

13. An absorbent nonwoven article comprising:

(a) a nonwoven web comprised of organic fibers, said organic fibers comprised of polymers having a plurality of pendant hydroxyl groups; and (b) a binder coated on at least a portion of said fibers, said binder consisting essentially of syndiotactic polyvinyl alcohol having a plurality of hydroxyl groups, said syndiotactic polyvinyl alcohol having a triad syndiotacticity of said hydroxyl groups of at least 30%.

14. An absorbent nonwoven article comprising:

(a) a nonwoven web comprised of organic fibers, said organic fibers comprised of polymers having a plurality of pendant hydroxyl groups; and (b) a binder coated on at least a portion of said fibers, said binder comprising syndiotactic polyvinyl alcohol having a plurality of hydroxyl groups, said syndiotactic polyvinyl alcohol having a triad syndiotacticity of said hydroxyl groups of at least 30%, wherein said binder is essentially free of a chemical crosslinking agent.

15. An absorbent nonwoven article comprising:

(a) a nonwoven web comprised of organic fibers, said organic fibers comprised of a combination of rayon fibers and polyvinyl alcohol fibers; and (b) a binder coated on at least a portion of said fibers, said binder consisting essentially of syndiotactic polyvinyl alcohol having a plurality of hydroxyl groups, said syndiotactic polyvinyl alcohol having a triad syndiotacticity of said hydroxyl groups of at least 30%.

16. An absorbent article in accordance with claim 1 wherein the syndiotactic polyvinyl alcohol is hydrolyzed poly(vinyl trifluoroacetate-co-(3-allyl-2,2'-dihydroxy-4,4'-dimethoxybenzophenone)).

* * * * *

UNITED STATES PATENT AND TRADEMARK OFFICE

CERTIFICATE OF CORRECTION

PATENT NO. : 6,013,587
DATED : January 11, 2000
INVENTOR(S) : Jack G. Truong, Bradford B. Wright and Michael M. Rock, Jr.

It is certified that error appears in the above-identified patent and that said Letters Patent is hereby corrected as shown below:

Title Page, Item [75] Inventors Section, please delete "Willa M. Studiner, Oakdale;".

Page 2, References Sheet,
"6238793" should read --62238793--.
389833 Japan" should read --389833 EP--.
419396 Japan" should read --419396 EP--.

Column 6,
Line 54, "ethylenenically" should read --ethylenically--.
Line 58, "ethylenenically" should read --ethylenically--.

Column 8,
Line 18, after "may" insert --be--.

Column 11,
Line 52, "glyoxal" should read --Glyoxal--.

Column 13,
Line 52, Example 10, "5 wt. %" should read --15 wt. %--.

Column 15,
Line 25, "21.92" should read --21.82--.

Column 16,
Line 49, "abs/(ft)" should read –abs/($ft^2$)--.

Column 18,
Line 38, "68" should read --88--.

Column 19,
Line 20, "50% Tyzor LA" should read --5% Tyzor LA--.

UNITED STATES PATENT AND TRADEMARK OFFICE

CERTIFICATE OF CORRECTION

PATENT NO. : 6,013,587
DATED : January 11, 2000
INVENTOR(S) : Jack g. Truong, Bradford B. Wright and Michael M. Rock, Jr.

It is certified that error appears in the above-identified patent and that said Letters Patent is hereby corrected as shown below:

Column 26,
Line 22, "110.29" should read --110.28--.

Column 27,
Line 34, "20 mol 5" should read --20 mol %--.
Line 53, "mol % Tyzor LR" should read --mol % Tyzor LA--.

Column 28,
Line 11, "mol % Tyzor LR" should read --mol % Tyzor LA--.

Signed and Sealed this

Twenty-sixth Day of June, 2001

Nicholas P. Godici

*Attest:*

*Attesting Officer*

NICHOLAS P. GODICI
*Acting Director of the United States Patent and Trademark Office*